United States Patent [19]

Hanyu et al.

[11] Patent Number: 4,478,161

[45] Date of Patent: Oct. 23, 1984

[54] SWITCHING DEVICE OF A DOUBLE-FUNCTION SEWING MACHINE

[75] Inventors: Susumu Hanyu; Noboru Kasuga, both of Tokyo; Reishi Nomota, Kanagawa; Yoshikazu Ebata, Tokyo, all of Japan

[73] Assignee: Janome Sewing Machine Co., Ltd., Tokyo, Japan

[21] Appl. No.: 459,622

[22] Filed: Jan. 20, 1983

[30] Foreign Application Priority Data

Jan. 26, 1982 [JP] Japan ..... 57-9594

[51] Int. Cl.[3] ..... D05B 1/14

[52] U.S. Cl. ..... 112/155

[58] Field of Search ..... 112/155, 168

[56] References Cited

U.S. PATENT DOCUMENTS 4,267,786 5/1981 Hanyu et al. ..... 112/168

4,343,250 8/1982 Hanyu et al. ..... 112/168

FOREIGN PATENT DOCUMENTS 2901139 12/1979 Fed. Rep. of Germany ..... 112/155

*Primary Examiner*—Werner H. Schroeder

*Assistant Examiner*—Andrew M. Falik

*Attorney, Agent, or Firm*—Michael J. Striker

[57] ABSTRACT

A double-function sewing machine, which is provided with a lock stitch forming mechanism and an overlock stitch forming mechanism, has a common driving source and a common flywheel for the two mechanisms. The sewing machine is provided with a switching device which includes a switch key connected to the flywheel of the machine. The switch key is selectively switchable to engage the shaft of the lock stitch-forming mechanism or a drive of the overlock stitch-forming mechanism. The switching device further includes a switching pawl which is engageable with and disengageable from the drive of the overlock stitch forming mechanism to hold the latter when the lock stitch forming mechanism is operated.

3 Claims, 7 Drawing Figures

SWITCHING DEVICE OF A DOUBLE-FUNCTION SEWING MACHINE

BACKGROUND OF THE INVENTION

The invention relates to a switch device of a double-function sewing machine which is provided with two different stitch-forming mechanisms.

SUMMARY OF THE INVENTION

A first object of the invention is to use, in common, a driving source and a flywheel for the two aforementioned mechanisms, to thereby make the whole body of the sewing machine compact.

A second object of the invention is to manually switch the two stitch-forming mechanisms while the sewing machine is stopped, to thereby avoid danger occurring in the prior art sewing machines, that a main shaft of a non-selected mechanism is rotated less than one rotation before a mechanical switch is finished. It is a further object of the invention to avoid a possible shock to the mechanism and to prevent the upper thread of the non-selected mechanism from slipping out from the thread path.

Yet another object of the invention is to make an exact connection between the selected stitch-forming mechanism and the driving source, and to exactly break a connection between the non-selected mechanism and the driving source and to engage it with a switching phase for keeping safety during the driving.

A still further object of the invention is to drive the selected mechanism by the drive source and also to carry out a rotational operation thereof in two opposite directions by manual operation of the flywheel, so that the flywheel may be manually adjusted during the stitch formation.

Still another object of the invention is to stop the selected mechanism together with the flywheel during coiling the thread on a thread supply.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIGS. 4 and 5 are vertical cross sectional views of the main part of the switch device, wherein FIG. 4 shows a selection of a lock stitch mechanism and FIG. 5 shows a selection of an overlock stitching mechanism;

DETAILED DESCRIPTION OF THE PREFERRED EMBODIMENTS

Figure 1:
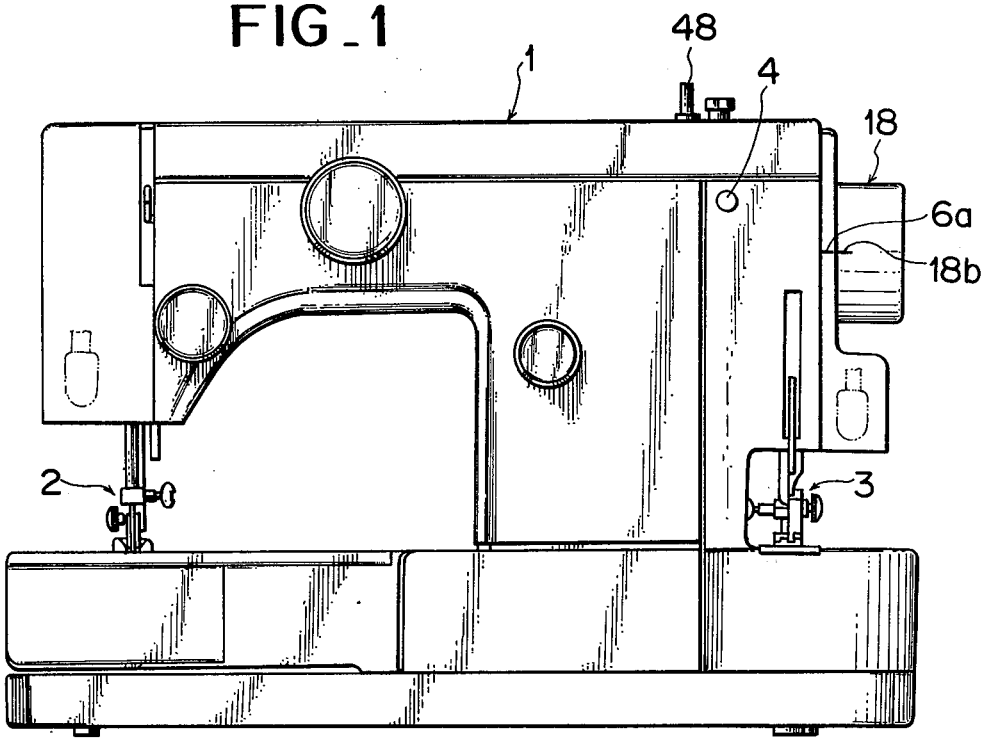
FIG. 1 shows a side view of a double-function sewing machine.
Figure 3:
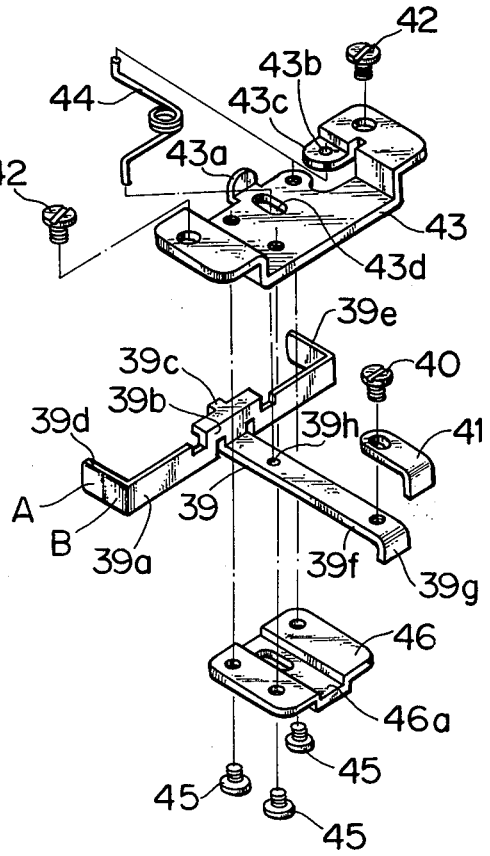
FIG. 3 shows an exploded view of the main part of the switch device, not seen in FIG. 2.

Embodiments according to the invention will be explained in reference to the attached drawings. In FIG. 1, the reference numeral 1 is a double-function sewing machine, 2 is a stitching portion of a lock stitch-forming mechanism (called as "lock stitch mechanism"), and numeral 3 is a stitching portion of an overlock stitch-forming mechanism (called as "overlock stitch mechanism"). These stitching mechanisms are alternatively driven as later mentioned by one driving motor (not shown) via transmission mechanisms and switching mechanisms. The reference numeral 4 is a window formed on the side of the lock stitching mechanism, and the other window (not shown) is formed at the opposite side for the overlock stitching mechanism in order to indicate either selected one.

Figure 4:
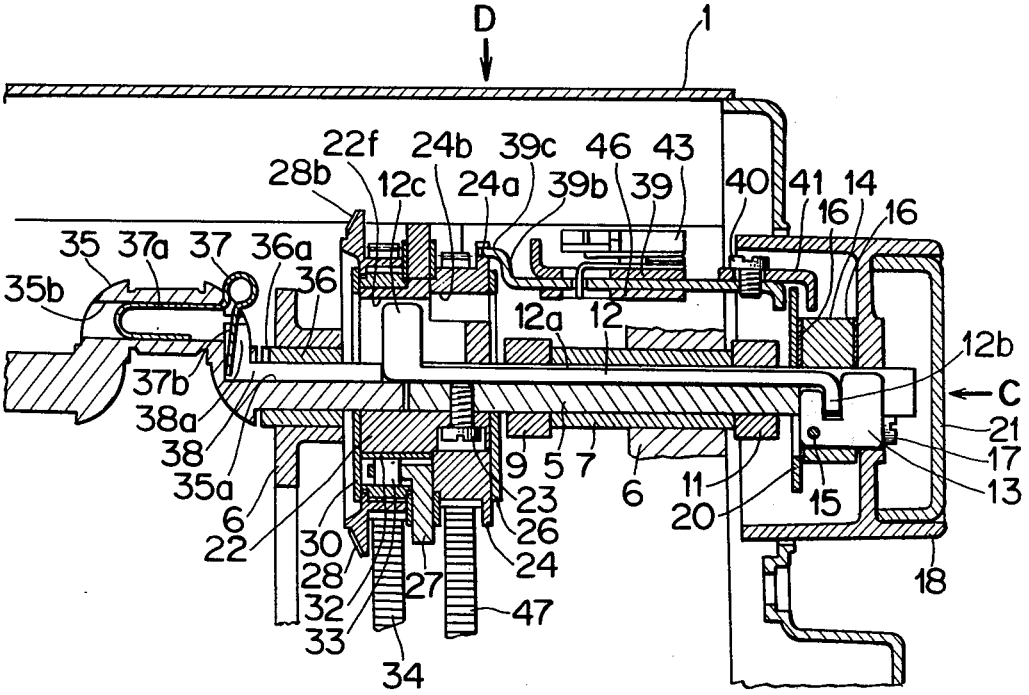
Figure 5:
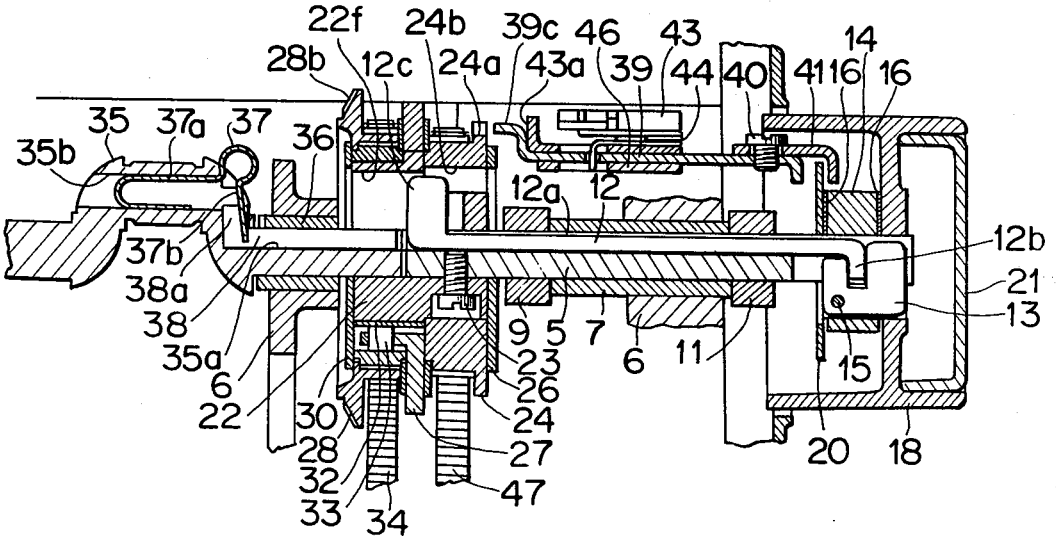
Figure 6:
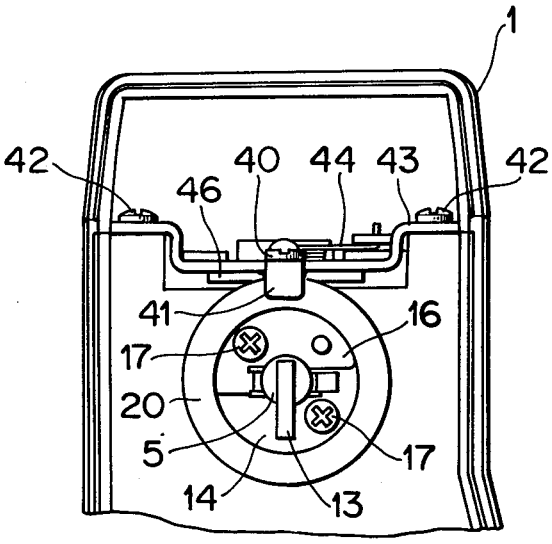
FIG. 6 is a view showing the main part seen from arrow C in FIG. 4.

An explanation will be made in reference to FIGS. 2, 4 and 5. The reference numeral 5 designates a flywheel shaft which is pivoted by a flywheel bearing 7 secured on a machine frame 6 and is stopped by a ring 11 which is secured by a ring 9 and a screw 10 fixed to the flywheel shaft 5 by a screw 8.

The flywheel shaft 5 is formed with a couple of fitting grooves **5*a* and 5*b*. The respective fitting grooves 5*a* and 5*b* formed on the opposite side of the shaft are not seen. A key groove 5*c* and a slot 5*d* are also formed in shaft 5. Within the key groove 5*c*, a switch key 12 is slidably guided at its connector 12*a*, while within the slot 5*d*, a communicating plate 13 is slidably guided. A groove 13*a* of the communicating plate 13 is engaged with a communicating portion 12*b* of the switch key 12**.

The communicating plate 13 is fixedly fitted in a groove **14*a* of an element 14 by means of a pin 15 which passes through a hole 14*b* formed in the element 14 and a hole 13*b* of the plate 13. While element 14 is secured via a switching spring 16 with a flywheel 18 by screws 17, it is also secured via the other switching spring 16' with a switch transmission plate 20 by means of screws 19**.

The numeral 21 is a cover for the flywheel 18, and a projection **21*a* thereof is elastically fitted into a plurality of grooves 18*a***.

The spring portions **16*a* of the respective springs 16 and 16' are engaged in respective grooves 14*c* of the element 14 and projections 16*b* of those springs alternatively engage one of the couple of the grooves 5*a* and 5*b* provided at the opposite sides of shaft 5**.

The numeral 22 shows a belt wheel bush (note that "22" shows the belt wheel bush in two places for convenience to illustrate opposite sides of this bush). A boss **22*a* of bush 22 is formed with a screw passing hole 22*b*, and a screw 23 is screwed into a screw hole 5*e* so that the bush 22 is secured to the flywheel shaft 5. Screw hole 5*e* does not pass through the key groove 5*c* of the shaft 5. The boss 22*a* is rotatably mounted with an overbelt wheel 24 on its outer circumference, and said overbelt wheel is engaged by a washer 26 which is secured to the face of the boss 22*a*. The belt wheel bush 22 is defined with a declutch seat 22*e* extended over a large diameter part 22*c* and a flange part 22*d*. The flange part 22*d* has mounted thereon a stopper cam 27, and the large diameter part 22*c* has mounted thereon a belt wheel 28 and is engaged with a washer 30 secured to the belt wheel bush 22 by screws 29. The belt wheel bush 22 is formed with a groove 22*f*. The switching portion 12*c* of the switching key 12 may slide between said groove 22*f* and key groove 35*a* of a lock stitching upper shaft 35** by external operation.

The overbelt wheel 24 is formed with a belt gear **24*c*, an engaging groove 24*a* and a groove 24*b***, and is connected with the overlock mechanism 3 via a belt 47 mounted on the belt gear 24c.

Figure 2:
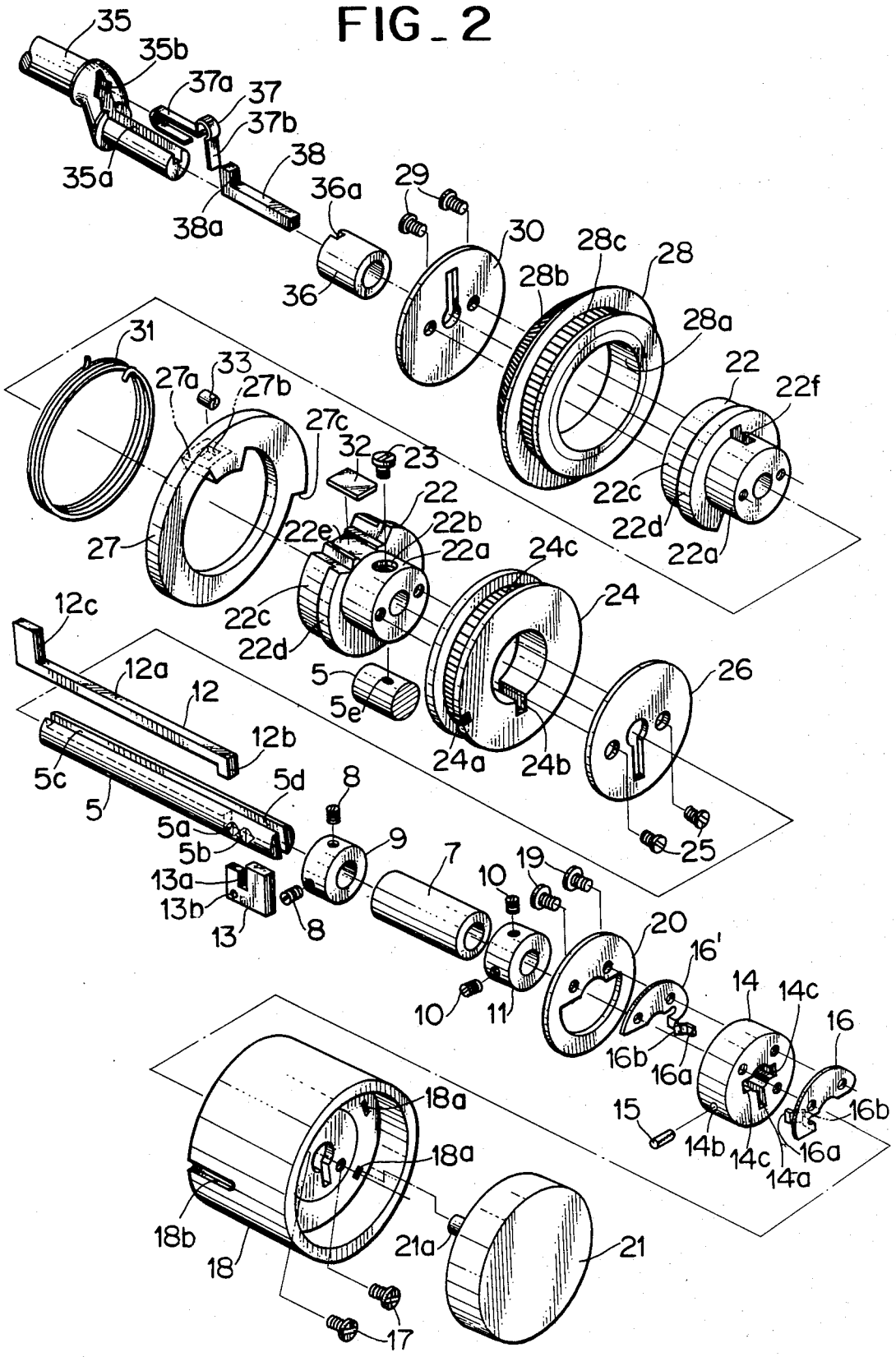
FIG. 2 shows an exploded view of a main part of a swtich device.

The stopper cam 27 is biased in the clockwise direction in FIG. 2 with respect to the belt wheel bush 22 by means of a twisted coil spring 31 which is positioned between the stopper cam 27 and the belt wheel bush 22. A guide member 27a is positioned at a space between an auxiliary plate 32 mounted on the declutch seat 22e and an inner circumference 28a of the belt wheel 28, and guides a roller 33 to a narrower space than said space formed by means of the guide groove 27b.

The belt wheel 28 is formed with a knurl 28b and a belt gear 28c, and is connected with a motor (not shown) via a belt 34 mounted on the belt gear 28c. The knurl 28b is connected with a driving wheel (not shown) which is provided on a thread stand 48 (FIG. 1) of thread winding mechanism so that the thread stand 48 is driven by the knurl.

The lock stitching upper shaft 35 is formed with the key groove 35a and a guide hole 35b, and is secured to the machine frame 6 and supported by a metal bush 36. A lock key spring 37 is guided within a guide hole 35b at its fitting portion 37a. A lock key 38 having an engaging portion 38a is slidably guided within the key groove 35a, and is biased toward the right side in FIG. 4 by a spring portion 37b of the lock key spring 37. The lock key 38 is pushed rightward in FIG. 2 within the key groove 35a by the lock key spring 37 at its spring portion 37b in the switching phase of the flywheel 18, so that engaging portion 38a of key 38 is engaged with an engaging groove 36a of the metal bush 36.

A further explanation will be made in reference to FIGS. 3, 4, 5 and 7. The numeral 39a is a main body of a switching pawl 39, which is formed with an engaging face 39b and a fitting portion 39c bent at a center part thereof, and extended bent indicators 39d and 39e. In the present embodiment, the indicator 39d has a red colored end portion (A) and a blue colored base portion (B), and the indicator 39e, though not shown, has a blue colored end portion (A) and a red colored base portion (B), so that the switching condition is shown at the lock stitching window 4 and the overlock stitching window (not shown). The main body 39a has an extended sliding part 39f whose end 39g is bent downwardly, on which a pawl 41 is secured by a screw 40. In setting up, a switch transmission plate 20 (FIG. 4) is positioned between an outer face of a working portion 39g and an inner face of the pawl 41.

A switching pawl bed 43 is secured to the machine frame 6 by a screw 42, and is formed with an engaging projection 43a, an engaging piece 43c having a hole 43b holding a toggle spring 44 and a hole 43d releasing it. The switching pawl 39 is positioned at its sliding part 39f slidably lengthwise between a lower face of the switching pawl bed 43 and a groove 46a of a guide plate 46 secured to the switching pawl bed 43. Said toggle spring 44 is held at its one end in the hole 43b and in a holding hole 39h via the releasing hole 43d.

Figure 7:
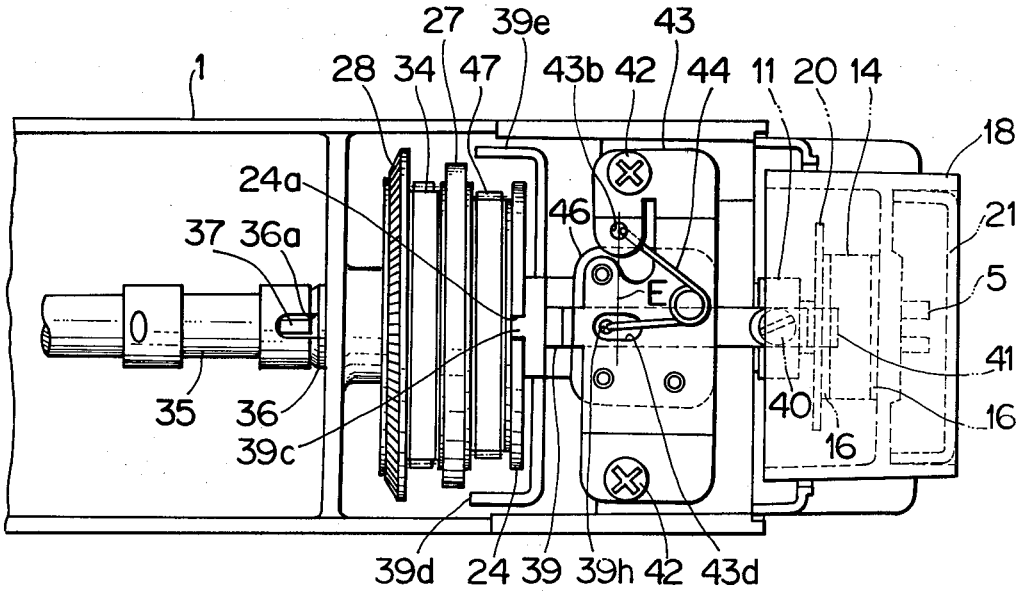
FIG. 7 is a view showing the main part seen from arrow D in FIG. 4.

With respect to the toggle spring 44, FIG. 7 shows that if the holding hole 39h is positioned at the left in regard to a segment E running along the shortest distance between the holding hole 43b and the holding hole 39h, the spring 44 biases a switching pawl 39 leftward so that the fitting portion 39c is engaged with a fitting groove 24a of an overbelt wheel 24, and if the holding hole 39h is positioned at the right, the spring 44 biases the switching pawl 39 rightward so that the engaging face 39b of the switching pawl 39 contacts the engaging projection 43a of the switching pawl bed 43.

At a phase where the fitting groove 24a of the overbelt wheel 24 engages the fitting portion 39c of the switching pawl 39, the engaging portion 38a of the lock key 38 guided within the lock stitching upper shaft 35 may engage the engaging groove 36a of the metal bush 36. At this phase, the switching key 12 is slidable between the key groove 5c of the flywheel shaft 5 and the key groove 35a of the lock stitching upper shaft 35, and by this movement the switching part 12c of the switching key 12 moves between the groove 22f of the belt wheel bush 22 and the groove 24b of the overbelt wheel 24.

A further reference will be made to the operation of the present invention. FIG. 4 shows the selection of the lock stitching mechanism, in which the switching portion 12c of the switching key 12 is engaged within the groove 22f of the belt wheel bush 22 and the key groove 35a of the lock stitching upper shaft 35. The engaging portion 39c of the switching pawl 39 which is biased leftward in FIG. 4 by the toggle spring 44 is engaged within the engaging groove 24a of the overbelt wheel 24.

Under this condition, if the belt wheel bush 22 is rotated by the driving source through the belt 34, the belt wheel 28 and the roller 33, the lock stitching upper shaft 35 is driven, which is connected to the lock stitching mechanism 2 via the groove 22f, the switching portion 12c and the key groove 35a, and the flywheel 18 is driven via the switching key 12, the transmission plate 13 and element 14.

Under the selecting condition of the lock stitching mechanism, since the switching portion 12c of the switching key 12 comes out of the groove 24b of the overbelt wheel 24, rotation of the belt wheel bush 22 is not transmitted to the overbelt wheel 24, and since the engaging groove 24a is held by the fitting portion 39c of the switching pawl 39, the non-selected overlock stitching mechanism 3 connected to the overbelt wheel 24 via the belt 47 is maintained stopped with safety.

The lock stitching mechanism is switched to the overlock stitching mechanism by manually rotating the flywheel 18 during the stopping of the sewing machine and meeting an indicator line 18b and an indicator line 6a (FIG. 1) of the machine frame 6. This rotating position corresponds to a switching phase of the flywheel 18, and at this phase the groove 22f of the belt wheel 22 and the groove 24b of the overbelt wheel 24 meet each other, and if the flywheel 18 is moved rightward in FIG. 4, the projection 16b of the switching spring 16 comes out of the engaging groove 5a of the flywheel shaft 5 and engages the groove 5b, to set the position of the flywheel 18 for the flywheel shaft 5. By this moving operation, the switching key 12 is moved rightward via the pin 15, the transmission plate 13 and the transmission part 12b of the switch key 12. FIG. 5 shows that the switching portion 12c of the switching key 12 comes out of the groove 22f of the belt wheel bush 22 and the key groove 35a of the lock stitching upper shaft 35 engages the groove 24b of the overbelt wheel 24 and moves in the key groove 35a the lock key 38 by biasing force of the lock key spring 37. The engaging portion 38a engages the groove 36a of the metal bush 36, and the switching pawl 39 is moved rightward by said movement through the switch transmission plate 20 and the pawl 41. The switching pawl 39 contacts at the engaging face 39b the projection 43a of the switching pawl bed 43 so that the engaging part 39*c* comes out of the groove 24*a* of the overbelt wheel 24. Thus, the switching is completed from the lock stitching mechanism 2 to the overlock stitching mechanism 3.

Under the condition of selecting the overlock stitching mechanism 3, when the belt wheel bush 22 is rotated via the driving source, the belt 34, the belt wheel 28 and the roller 33, the overbelt wheel 24 is rotated via the groove 22*f*, the switching portion 12*c* and the groove 24*b*, and the overlock stitching mechanism 3 is driven via the belt 47, and the flywheel 18 is rotated via the switching key 12, the transmission plate 13 and the element 14.

Under the condition of selecting the overlock stitching mechanism 3, the rotation of the belt wheel bush 22 is not transmitted to the lock stitching upper shaft 35, and since the lock stitching upper shaft 35 is engaged to the machine frame 6 via the lock key 38 and the metal bush 36, the non-selected lock stitching mechanism 2 is maintained stopped with safety.

The overlock stitching mechanism 3 is switched to the lock stitching mechanism 2 by manually moving the flywheel 18 to the switching phase of the flywheel 18 during the stopping of the sewing machine. If the flywheel 18 is moved leftward at said phase, the projection 16*b* of the switching spring 16 comes out of the groove 5*b* of the flywheel shaft 5 and is engaged with the groove 5*a*, and the flywheel 18 is positioned to the flywheel shaft 5. By this movement the switching ke6 12 is moved leftward, and the switching portion 12*c* engages the groove 22*f* of the belt wheel bush 22 and the key groove 35*a* of the lock stitching upper shaft 35. The engaging portion 39*c* of the switching pawl 39 is engaged with the groove 24*a* of the overbelt wheel, and the lock key 38 is moved leftward against the biasing force of the lock key spring 37. The engaging portion 38*a* comes out from the groove 36*a* of the metal bush 36. Thus the switching from the overlock stitching mechanism 3 to the lock stitching mechanism 2 is completed.

As mentioned above, the switching is completed by the manual operation by axially moving the flywheel 18 after having rotated it to the switching phase, to thereby avoid danger occurring in the prior art sewing machines that the main shaft of the non-selected mechanism is rotated less than one rotation before the mechanical switch is finished, to prevent shocks to which the mechanism is usually subjected or to prevent the upper thread of the non-selected mechanism from slipping out from the thread path.

The stitching mechanism selected under the selecting condition can not only be driven by the drive source but can also be rotated in the forward and backward directions by the manual operation of the flywheel 18, so that the flywheel may be manually adjusted during the stitch formation, if required.

Coiling of the thread will be now explained. When a lower thread bobbin (not shown) is set on a thread stand 48, and the thread stand is switched from a releasing side to a coiling side, a driving wheel (not shown) is pressed to the knurl 28*b* of the belt wheel 28. Under this condition, when a lever (not shown) cooperating with the thread stand 48 enters the moving locus of the engaging face 27*c* of the stopper cam 27 and the belt wheel 28 is rotated by the driving source via the belt 34 while the stopper cam 27 is prevented from the rotation in the clockwise direction as viewed from the flywheel 18, and since the roller 33 is pushed to the space wider than the space between the plate 32 and the inner circumference 28*a* of the belt wheel 28, the belt wheel 28 is idle with respect to the belt wheel bush 22, and the thread stand 48 is rotated by the knurl 28*b* via the driving wheel. Thus, the thread is coiled. During this period, the flywheel 18 and the selected stitching mechanism are maintained stopped, since the belt wheel bush 22 serves as the driving source therefor. The non-selected mechanism is, of course, stopped.

When the thread stand 48 is released from the thread coiling side after the completion of the thread coiling, the driving wheel separates from the knurl 28*b* of the belt wheel 28, and said lever (not shown) cooperating with the thread stand 48 is moved outside of the moving locus of the engaging face 27*c* of the stopper cam 27, and the stopper cam 27 returns the roller 33 to the initial position. Therefore the roller 33 again transmits the driving force from the belt wheel 28 to the belt wheel bush 22, and the selected stitching mechanism is driven together with the flywheel 18.

It will be understood that each of the elements described above, or two or more together, may also find a useful application in other types of double-function sewing machines differing from the types described above.

While the invention has been illustrated and described as embodied in a switching device of a double-function sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a double-function sewing machine having a lock stitch forming mechanism and an overlock stitch forming mechanism, a rotatable flywheel and a machine frame, a switching device for switching the sewing machine for lock stitching or overlock stitching comprising a flywheel shaft rotatably supported in the machine frame; a switching key slidably displaceable with respect to said flywheel shaft lengthwise thereof and having an end connected to the flywheel and rotatable integrally with said flywheel shaft; a belt wheel bush secured to the flywheel shaft; a first belt wheel rotatable by a driving source and operatively connected to said belt wheel bush for rotation thereof; a second belt wheel operatively connected to the overlock stitch mechanism by a belt and rotatably supported on said belt wheel bush; a lock stitching upper shaft connected to the lock stitching mechanism, said upper shaft being rotatable in the machine frame and arranged coaxial with said flywheel shaft; said switching key being selectively engageable with said belt wheel bush and with said lock stitching upper shaft to connect said belt wheel bush to said lock stitching upper shaft or with said belt wheel bush and with said second belt wheel to connect said belt wheel bush to said second belt wheel; and a switching pawl engageable with said second belt wheel and slidably guided with respect to the machine frame so as to enable the flywheel to be operated between a first position in which the belt wheel bush and the lock stitching upper shaft are connected by said switching key and a second position in which said belt wheel bush and said second belt wheel are connected by said switching key.

2. The sewing machine as defined in claim 1, wherein said switching pawl has a part engageable with said second belt wheel to hold the same when said flywheel is in the first position, and further comprising holding means to hold the first belt wheel when said flywheel is in the second position.

3. The sewing machine as defined in claim 2, wherein said flywheel is manually rotated to a switching state and is movable with respect to an axis thereof, said switching pawl being switchable at the switching phase of the flywheel.

* * * * *